US010149523B2

(12) United States Patent
Cooley

(10) Patent No.: US 10,149,523 B2
(45) Date of Patent: Dec. 11, 2018

(54) MAGNETIC SWIVEL UMBRELLA HOLDER SYSTEM

(71) Applicant: Joshua Mitchell Cooley, Chandler, AZ (US)

(72) Inventor: Joshua Mitchell Cooley, Chandler, AZ (US)

( * ) Notice: Subject to any disclaimer, the term of this patent is extended or adjusted under 35 U.S.C. 154(b) by 7 days.

(21) Appl. No.: 15/607,381

(22) Filed: May 26, 2017

(65) Prior Publication Data

US 2017/0342737 A1 Nov. 30, 2017

Related U.S. Application Data

(60) Provisional application No. 62/342,616, filed on May 27, 2016.

(51) Int. Cl.

| | |
|---|---|
| ***A45B 11/00*** | (2006.01) |
| ***E04H 12/22*** | (2006.01) |
| *A45B 23/00* | (2006.01) |

(52) U.S. Cl.

CPC ..... *A45B 11/00* (2013.01); *E04H 12/2238* (2013.01); *E04H 12/2269* (2013.01); *A45B 23/00* (2013.01); *A45B 2023/0025* (2013.01)

(58) Field of Classification Search

CPC ..... A45B 23/00; A45B 11/00; A45B 3/00; A45B 17/00; A45B 2023/0025; A45B 2200/109; E04H 12/2238; E04H 12/187; E04H 12/22; E04H 12/2253

USPC ..... 135/16, 98; 116/173; 248/514, 516, 519, 248/520–521, 528

See application file for complete search history.

(56) References Cited

U.S. PATENT DOCUMENTS

| | | | | |
|---|---|---|---|---|
| 2,962,248 | A * | 11/1960 | Ertel | H01Q 1/084 224/309 |
| 5,396,915 | A * | 3/1995 | Bomar | A45B 11/00 135/16 |
| 6,213,440 | B1 * | 4/2001 | Kornback | B60R 13/005 248/206.5 |
| 7,188,821 | B2 * | 3/2007 | Curtis | E01F 9/681 248/206.5 |
| 7,296,377 | B2 * | 11/2007 | Wilcox | A01K 91/08 114/255 |
| 7,614,600 | B1 * | 11/2009 | Smith | G09F 23/00 135/16 |
| 7,669,361 | B2 * | 3/2010 | Baez | A01K 91/08 114/255 |
| 8,714,511 | B2 * | 5/2014 | Zoeteman | A45B 23/00 135/16 |
| 2005/0151034 | A1 * | 7/2005 | Shendelman | A47F 5/04 248/121 |
| 2011/0006968 | A1 * | 1/2011 | Morrow | H01Q 1/084 343/882 |

(Continued)

*Primary Examiner* — Winnie Yip
(74) *Attorney, Agent, or Firm* — Keith A. Miller

(57) ABSTRACT

A magnetic umbrella swivel holder system comprising a swivel umbrella holder, further comprising an upper portion and a lower portion, wherein the upper portion is a first tube with a diameter sized to hold an umbrella pole, the lower portion is a second tube. Preferably, the upper portion is connected to the lower portion with a pivot device. A magnet is preferably removably attached to the lower portion using a fastener that threadably attaches to a receptacle fitted within the lower portion such that the magnet forms a bottom surface.

18 Claims, 4 Drawing Sheets

(56) References Cited

U.S. PATENT DOCUMENTS

| | | | | |
|---|---|---|---|---|
| 2015/0366180 | A1* | 12/2015 | Chmura | A01K 97/10<br>248/514 |
| 2016/0037762 | A1* | 2/2016 | Thomas | A01K 97/10<br>248/636 |
| 2017/0295895 | A1* | 10/2017 | Volin | A45B 17/00 |

* cited by examiner

MAGNETIC SWIVEL UMBRELLA HOLDER SYSTEM

CROSS-REFERENCE TO RELATED APPLICATION

The present application is related to and claims the benefit under 35 U.S.C § 119(e) of the prior U.S. provisional application Ser. No. 62/342,616 filed May 27, 2016 entitled "Magnetic Swivel Mount Umbrella", the contents of which are incorporated herein by this reference in their entirety, and are not admitted to be prior art with respect to the present invention by the mention in this cross-reference section.

BACKGROUND OF THE INVENTION

The present invention relates to the field of umbrella holders. In particular, the present invention relates to a magnetic swivel umbrella holder system.

People in many different occupations often work outdoors. Working outdoors can be hazardous at various times during the year. For example, in the summertime or in warm weather climates, the daytime temperatures are often relatively high with temperatures ranging from 80 to 110 degrees. It is widely known that working in these relatively high temperatures as well as in direct sunlight for extended periods of time can be hazardous for such workers, causing greater fatigue, heat stroke, sunburn, and other heat related conditions. Additionally, working outdoors can expose workers to other weather conditions such as rain or hail.

Outdoor workers thus often try to work in shaded or covered areas when possible. In addition to protection from rain, shaded areas are typically between 5 and 20 degrees cooler than un-shaded areas of direct sunlight. However, shaded areas can be difficult to find in specific work areas, such as construction sites or on roofs. These sites often don't have structures to secure shading devices, such as umbrellas, so the worker does not have any place to anchor an umbrella or other shading device.

Outdoor workers that workers that need to work on roofs typically have greater issues regarding finding shade. For instance, commercial air conditioning (AC) units are often situated on the roofs of buildings. The AC unit installers, mechanics, and other service technicians often have to work on roofs of buildings to install and service such equipment. The temperatures on roofs are typically 10 to 20 degrees higher than the temperatures on the ground due to direct exposure to the sun. These workers often need to spend many hours on roofs installing or servicing AC units. In addition to these higher temperatures on roofs, roofs typically have less, or little to no, shaded areas.

An additional problem with working on roofs is that roofs often have few, if any, places to secure shading devices. As mentioned above, one well known way to provide shade for outdoor workers is by using an umbrella. Various different types of umbrellas are well known and can be used to shade a worker. However, there is usually no suitable location on the roof for the worker to mount the umbrella and adjust for shade or other coverage.

The combination of such umbrellas and stands are heavy and bulky, and workers do not want to carry these umbrellas and umbrella stands to their respective job sites (such as to roofs). Another reason is that many outdoor workers, such as AC technicians often work on multiple different units at multiple different locations each day. Each time the technician goes to a job site or location, they need to unload from their truck all of the tools and necessary equipment to service or fix the unit, and then repack their tools and equipment in their trucks after they are finished. Outdoor workers typically do not want to add the time and effort to their typical day by moving and setting up such heavy and bulky umbrella stands and umbrellas as well as their tools and equipment, especially when they work at multiple different locations during their typical day.

Accordingly, there is a need for a compact, adjustable, portable, light-weight strong umbrella holder for providing shade for people such as outdoor workers on roofs. Additionally, the present invention provides a means for adjusting the angle of the umbrella to allow for changes in the sun's position or the direction rain is falling.

Any discussion of prior art throughout the specification should in no way be considered as an admission that such prior art is widely known or forms part of the common general knowledge in the field.

BRIEF SUMMARY OF THE INVENTION

According to the present invention there is provided a magnetic swivel umbrella holder system comprising a swivel umbrella holder, further comprising an upper portion and a lower portion, wherein the upper portion is a first tube with a diameter sized to hold an umbrella pole and the lower portion is a second tube. Preferably, the upper portion is connected to the lower portion with a pivot device. A magnet is preferably removably attached to the lower portion using a fastener that threadably attaches to a receptacle fitted within the lower portion such that the magnet forms a bottom surface.

BRIEF DESCRIPTION OF THE DRAWINGS

The preferred embodiment of the present invention will now be described, by way of example only, with reference to the accompanying drawings in which.

DETAILED DESCRIPTION OF THE INVENTION

The foregoing and other objectives, features, and advantages of the invention will be more readily understood upon consideration of the following description of the invention taken in conjunction with the accompanying drawings.

Figure 1:
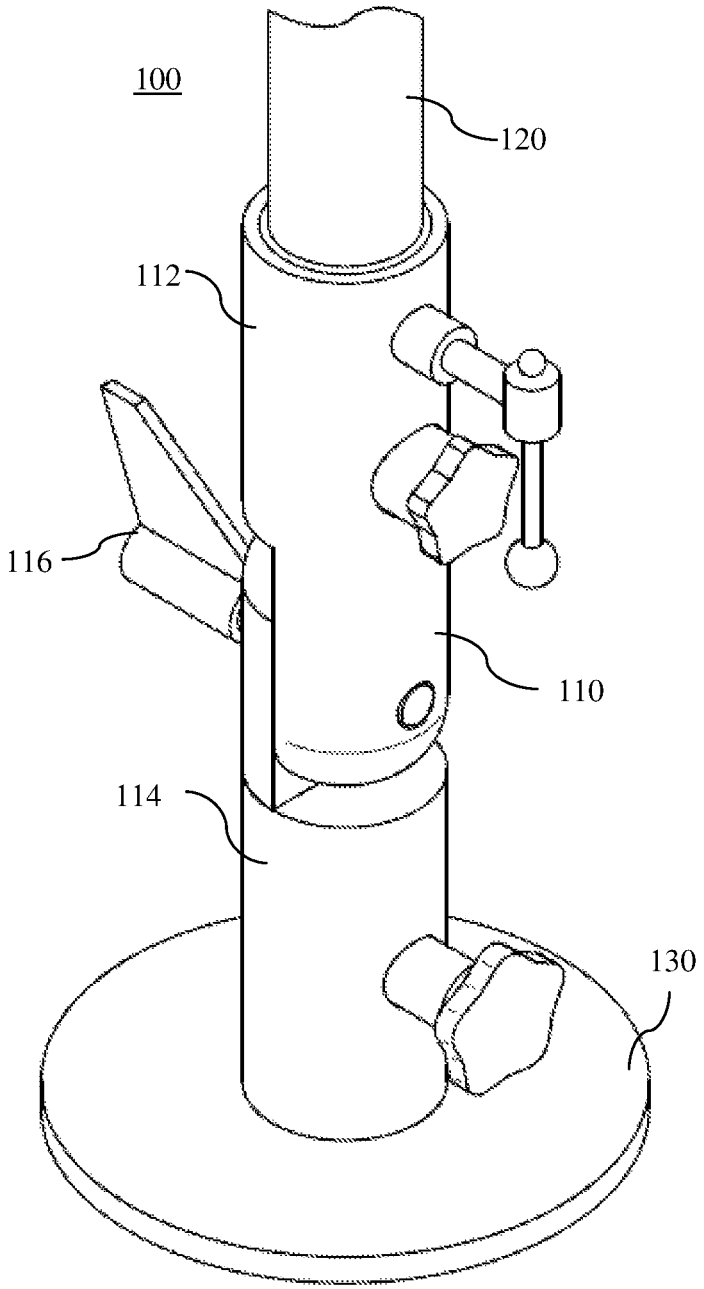
FIG. 1 shows a perspective view of a Magnetic Swivel Umbrella Holder System according to the invention.
Figure 2:
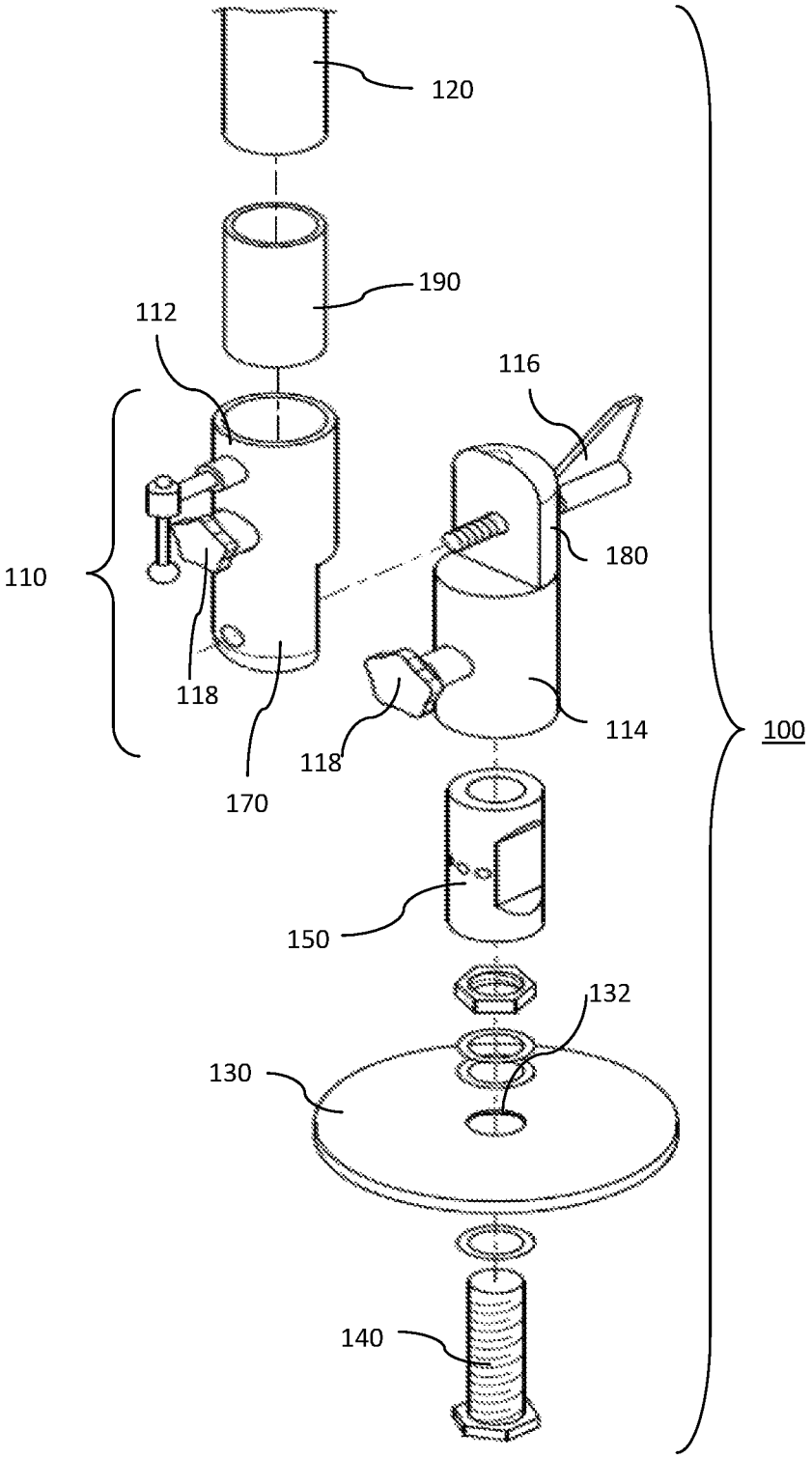
FIG. 2 shows an exploded perspective view of the Magnetic Swivel Umbrella Holder System according to the invention.
Figure 3:
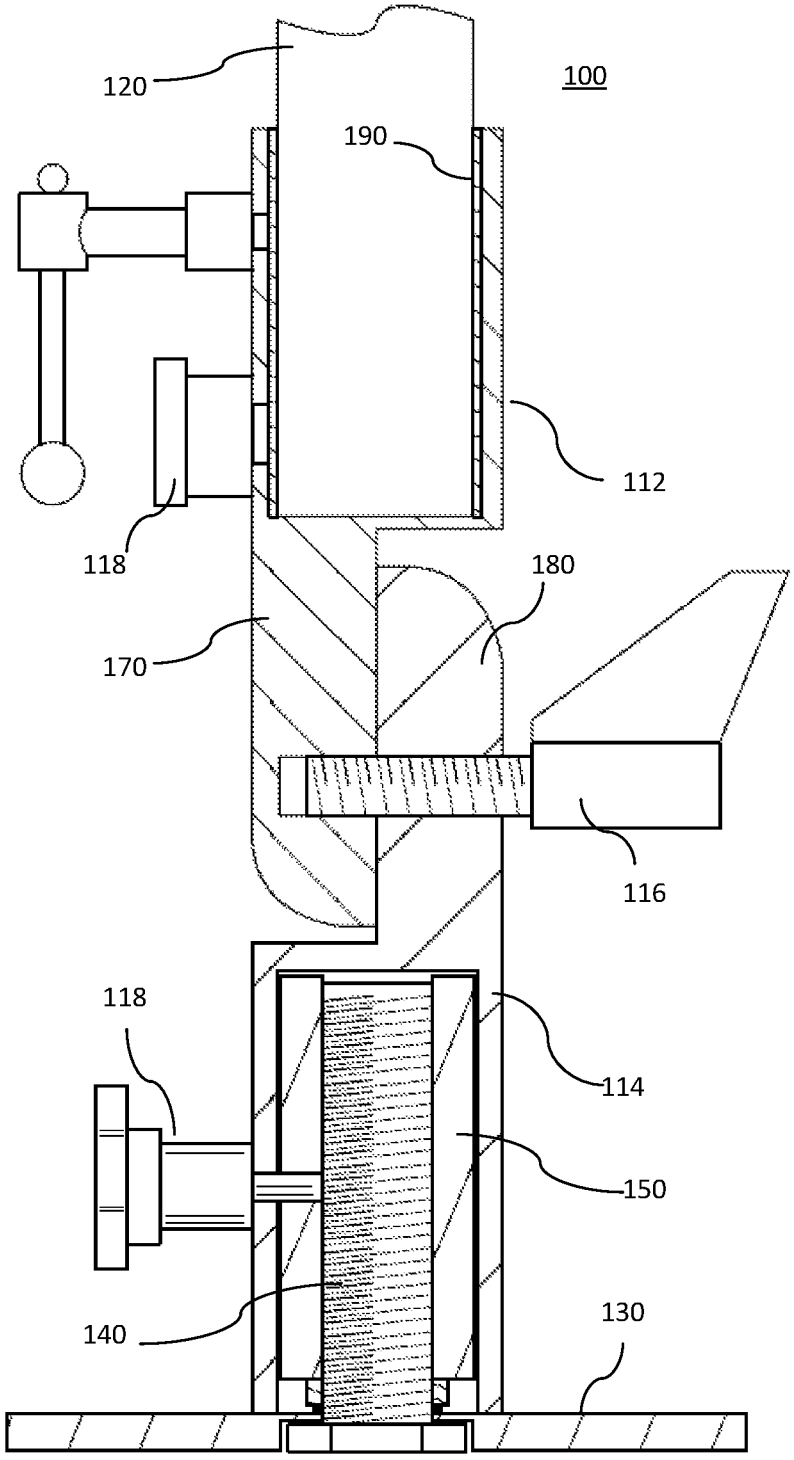
FIG. 3 shows a cross-sectional view of the Magnetic Swivel Umbrella Holder System according to the invention.

Now referring to the drawings, FIGS. 1-3 shows a magnetic swivel umbrella holder system 100 comprising a swivel umbrella holder 110, further comprising an upper portion 112 and a lower portion 114, wherein the upper portion is a first tube with a diameter sized to hold an umbrella pole 120, the lower portion is a second tube. Preferably, the upper portion is connected to the lower portion with a pivot device 116. A magnet 130 is preferably removably attached to the lower portion 114 using a fastener that mates with a receptacle 150 fitted within the lower portion 114 such that the magnet forms a bottom surface.

The receptacle 150 is preferably a cylindrical tube with an outside diameter closely matching the lower portion 114 inside diameter. The receptacle 150 preferably further comprises female fastener threads on an inside diameter for threadably accepting a threaded fastener 140 with matching male threads. The receptacle 150 is preferably made from a metallic material such as steel, but may alternately be fabricated from non-metallic materials such as various types of plastics.

Additionally, the receptacle 150 is preferably inserted into the lower portion 114 and secured in place using a set screw 118 that extends through a side wall of the lower portion 114 and makes contact with the outside surface of the receptacle 150. Alternately preferably, the receptacle 150 is glued into the lower portion 114 using an adhesive, such as epoxy. Alternately preferably, the receptacle 150 is integrally formed within the lower portion 114.

The magnet 130 is preferably removably attached to the receptacle 150 within the lower portion 114 using a threaded fastener 140. The present disclosure contemplates that one or more suitable washers 142 and/or lock washers may be employed in conjunction with the threaded fastener 140 to attach the magnet 130. The magnet 130 is preferably a ring magnet with a circular hole 132 through the center large enough for the threaded fastener 140 to be inserted through. The threaded fastener 140 is preferably a bolt, however, other suitable types of threaded fasteners not enumerated herein may be used.

The magnet 130 is preferably a ceramic magnet with an outer diameter of 4.90 inches (12.45 centimeters) and a height of approximately 0.50 inches to 0.75 inches (1.27 cm to 1.90 cm). The magnet preferably has a 210 pound (lb) (95.25 kilogram) pull weight. However, it should be appreciated that in accordance with the present disclosure: (a) the magnet can be made from other suitable materials; (b) the magnet can be made with other relatively high pull weights (for the relative area of the magnet); (c) the magnet can be made from multiple parts; and (d) the magnet can be formed in other suitable ways, shapes, sizes, and configurations provided that the magnet is strong enough to removably secure the umbrella swivel holder to a metal object while still being small enough to provide a portable, compact, lightweight, and strong enough umbrella swivel holder system which is configured to hold a relatively heavy umbrella. In various alternative embodiments, the magnet has a pull weight ranging from 160 lbs (72.57 kilograms) to 300 lbs (136.08 kilograms). It should be appreciated that multiple magnets can be employed to increase or obtain the desired pull weight, such as for extremely windy areas.

The umbrella swivel holder 110 preferably comprises a tubular upper portion 112 preferably open at a distal end and closed at a proximate end. The upper portion 112 is sized to accept an umbrella pole 120. A set screw 118 is inserted through a side wall and contacts the umbrella pole 120 to secure the umbrella pole within the upper portion 112. Further, the proximate end preferably further comprises an upper portion tab 170 extending from the proximate end of the upper portion 112. The upper portion tab 170 preferably comprises an upper portion bore 172 through the center of the upper portion tab 170 to allow a pivot device 116 to fit through.

The umbrella swivel holder 110 preferably comprises a tubular lower portion 114 preferably open at a distal end and closed at a proximate end. Further, the proximate end preferably further comprises a lower portion tab 180 extending from the proximate end of the lower portion 114. The lower portion tab 180 preferably comprises a lower portion bore 182 through the center of the lower portion tab 180 to allow a pivot device 116 to fit through and mate with the upper portion tab 170.

The upper portion 112 is preferably connected to the lower portion 114 with a pivot device 116 where the tabs mate and the bores align. The pivot device 116 is preferably a rod or bolt that inserts through the bores of the lower portion tab 180 and upper portion tab 170 when the tabs are placed next to each other and the bores align.

In an alternate embodiment, an umbrella sleeve 190 is inserted into the umbrella swivel holder upper portion 112 to provide greater stability for the umbrella, or to allow an umbrella with a smaller diameter umbrella pole to be inserted into the upper portion 112 of the umbrella swivel holder 110. In this alternate embodiment, the umbrella pole 120 is inserted into the umbrella sleeve 190. In this alternate embodiment, the umbrella sleeve 190 preferably further comprises a bore through a side wall allowing the set screw 118 to extend through and make contact with the umbrella pole 120. The umbrella sleeve 190 is preferably made of a metallic material, such as steel, but may be fabricated from plastic materials.

Figure 4:
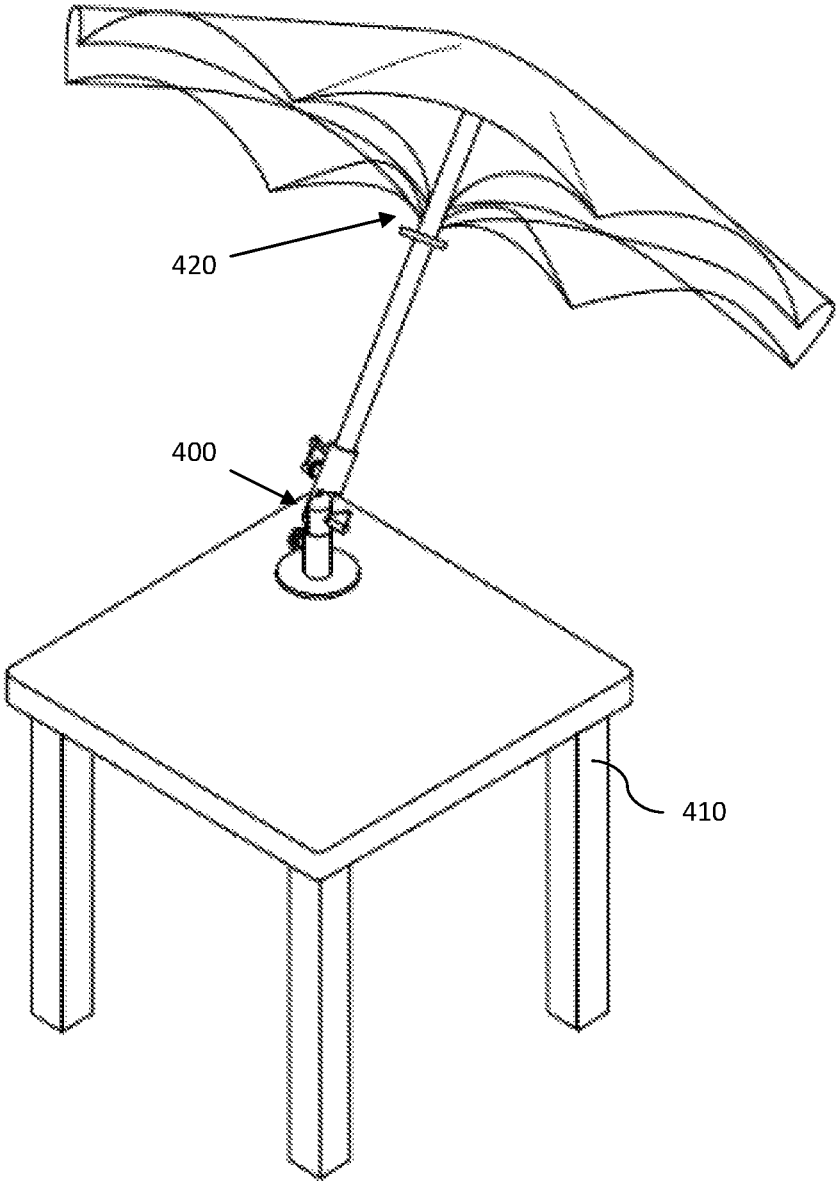
FIG. 4 shows a perspective view of the Magnetic Swivel Umbrella Holder System positioned on a magnetic structure with an umbrella providing shade.

As shown in FIG. 4, the magnetic swivel umbrella holder system 400 is designed to be placed on any magnetic surface, such as a patio table 410 to provide shade with the sun in various positions or protection from adverse weather. For outdoor work environments, the magnetic swivel umbrella holder system 400 can be located on the bed of a truck, or an air conditioning unit to provide adequate shade for the worker. Additionally, the umbrella swivel holder allows the umbrella 420 to be positioned at any angle to better protect the user or worker, such as when the sun moves across the sky or when rain falls at an angle.

Although the present invention has been described by way of example, it should be appreciated that variations and modifications may be made without departing from the scope of the invention. Furthermore, where known equivalents exist to specific features, such equivalents are incorporated as if specifically referred to in this specification.

What is claimed is:

1. A magnetic swivel umbrella holder system comprising:

a swivel umbrella holder, further comprising an upper portion further comprising an adjustment mechanism which may comprise a set screw configured to extend through a sidewall of said upper portion and contact an umbrella pole and a lower portion;

wherein said upper portion is connected to said lower portion with a pivot device; and a magnet removably attached to said lower portion using a threaded fastener that mates with a threaded receptacle fitted within said lower portion such that said magnet forms a bottom surface; wherein said magnet further comprises a center bore sized for said threaded fastener; and wherein said magnet is attached to allow said lower portion to swivel about said magnet.

2. The magnetic swivel umbrella holder system of claim 1, wherein said threaded receptacle is glued into said lower portion using an adhesive.

3. The magnetic swivel umbrella holder system of claim 1, wherein said threaded receptacle further comprises a cylindrical tube with female threads on an inside surface, wherein said female threads are configured to mate with said threaded fastener comprising male threads.

4. The magnetic swivel umbrella holder system of claim 1, wherein said threaded receptacle is integral to said lower portion.

5. The magnetic swivel umbrella holder system of claim 3, wherein said magnet is removably attached to said lower portion using said threaded fastener.

6. The magnetic swivel umbrella holder system of claim 1, wherein said magnet has a pull weight of approximately 210 pounds.

7. The magnetic swivel umbrella holder system of claim 1, wherein said threaded receptacle is made from metal.

8. The magnetic swivel umbrella holder system of claim 6, wherein said magnet is a ceramic magnet further comprising a center hole.

9. A magnetic swivel umbrella holder system comprising:

an umbrella;

a swivel umbrella holder, further comprising an upper portion further comprising an adjustment mechanism which may comprise a set screw configured to extend through a sidewall of said upper portion and contact said umbrella and a lower portion;

wherein said upper portion is a first tube, and said lower portion is a second tube, and wherein said upper portion is connected to said lower portion with a pivot device;

a tubular sleeve structured to accept an umbrella pole of said umbrella, wherein said tubular sleeve fits within said upper portion; and a magnet removably attached to said lower portion using a threaded fastener that mates with a threaded receptacle fitted within said lower portion such that said magnet forms a bottom surface;

wherein said magnet further comprises a center bore sized for said threaded fastener; and wherein said magnet is attached to allow said lower portion to swivel about said magnet.

10. The magnetic swivel umbrella holder system of claim 9, wherein said threaded receptacle is glued into said lower portion using an adhesive.

11. The magnetic swivel umbrella holder system of claim 9, wherein said threaded receptacle further comprises a tubular length of metal with female threads on an inside surface, wherein said female threads are sized to mate with said threaded fastener comprising male threads.

12. The magnetic swivel umbrella holder system of claim 9, wherein said threaded receptacle is integral to said lower portion.

13. The magnetic swivel umbrella holder system of claim 12, wherein said magnet is removably attached to said lower portion using said threaded fastener.

14. The magnetic swivel umbrella holder system of claim 9, wherein said magnet has a pull weight of approximately 210 pounds.

15. The magnetic swivel umbrella holder system of claim 9, wherein said threaded receptacle is made from metal.

16. The magnetic swivel umbrella holder system of claim 14, wherein said magnet is a ceramic magnet further comprising a center hole.

17. The magnetic swivel umbrella holder system of claim 9, wherein said tubular sleeve is made from steel.

18. The magnetic swivel umbrella holder system of claim 9, wherein said tubular sleeve is made from plastic.

* * * * *